US006154987A

United States Patent [19]

Rumer et al.

[11] Patent Number: 6,154,987

[45] Date of Patent: Dec. 5, 2000

[54] CUTTING TOOTH FOR A TRENCHER CHAIN

[75] Inventors: Larry James Rumer, Pella, Iowa; John H. Walgren, Lake Havasu City, Ariz.

[73] Assignee: Vermeer Manufacturing Company, Pella, Iowa

[21] Appl. No.: 09/138,792

[22] Filed: Aug. 24, 1998

[51] Int. Cl.[7] ..... E02F 3/14; B65G 15/00

[52] U.S. Cl. ..... 37/352; 37/448; 37/460; 37/465; 299/34.01; 299/84.1

[58] Field of Search ..... 37/446, 352, 448, 37/451, 460, 189, 464, 465, 462, 455, 380; 299/34.01, 34.02, 34.03, 34.04, 82.1, 84.1

[56] References Cited

U.S. PATENT DOCUMENTS

| | | | |
|---|---|---|---|
| 2,502,094 | 3/1950 | Kelsey . | |
| 2,519,076 | 8/1950 | Schmidt | 37/352 |
| 2,575,980 | 11/1951 | Simmons . | |
| 2,888,757 | 6/1959 | Sheen | 37/352 |
| 2,912,774 | 11/1959 | McCrary . | |
| 2,946,142 | 7/1960 | Swanson . | |
| 3,022,588 | 2/1962 | Brown . | |
| 3,063,691 | 11/1962 | Osgood | 37/455 X |
| 3,104,481 | 9/1963 | George et al. . | |
| 3,280,486 | 10/1966 | Hackel . | |
| 3,305,029 | 2/1967 | Shelton . | |
| 3,614,838 | 10/1971 | Wherry . | |
| 3,736,676 | 6/1973 | Sturgeon . | |
| 3,888,028 | 6/1975 | White . | |
| 4,294,183 | 10/1981 | Morgan . | |
| 4,571,859 | 2/1986 | Leischer | 37/352 |
| 4,651,449 | 3/1987 | Rose | 37/465 |
| 4,819,990 | 4/1989 | Breuer et al. . | |
| 4,924,609 | 5/1990 | Martin | 37/465 |
| 4,980,980 | 1/1991 | Schadov et al. . | |
| 5,235,961 | 8/1993 | McShannon | 175/426 X |
| 5,248,188 | 9/1993 | Walgren . | |
| 5,647,448 | 7/1997 | Skaggs | 37/460 X |

OTHER PUBLICATIONS

Shark Chain® sold by Consolidated Carbide, date unknown.

*Primary Examiner*—H. Shackelford
*Attorney, Agent, or Firm*—Merchant & Gould P.C.

[57] ABSTRACT

The present disclosure relates to a cutting tooth for a trencher chain. The tooth includes a base portion aligned along a first plane. The base portion includes structure for allowing the cutting tooth to be connected to the trencher chain. The tooth also includes a distal portion that is generally obliquely aligned with respect to the first plane. A curved transition is located between the distal portion and the base portion. The curved transition curves away from the first plane and at least partially forms a cupped portion that extends from a leading end to a trailing end of the cutting tooth. The tooth also includes a hardened tip positioned at a region of the leading end that is located farthest from the first plane.

22 Claims, 8 Drawing Sheets

CUTTING TOOTH FOR A TRENCHER CHAIN

FIELD OF THE INVENTION

The present invention relates generally to excavation machines. Specifically, the present invention relates to cutting teeth for use with trencher chains.

BACKGROUND OF THE INVENTION

Trenchers are conventionally used to dig lengths of trenches for laying underground pipe and cable. Most trenchers include a tractor unit equipped with an elongated boom. The boom is typically movable between a raised, generally horizontal position, and a lowered, substantially vertical position. The boom typically includes a cutting chain that is entrained about the boom. The chain generally includes exterior teeth or cutters for engaging the soil. Trenchers also commonly include a conveyer assembly for transporting the soil this is excavated by the chain.

There are various types of cutting teeth or attachments that are commonly bolted to a trencher digging chain. One of the most popular attachments is called a "cup tooth." An exemplary cup tooth cutter is disclosed in U.S. Pat. No. 3,022,588 to Brown. The '588 reference discloses a cup cutter having a leading edge and a cupped portion for scooping loose material from a trench. In use, essentially the entire leading edge of the cup cutter engages the wall of a trench.

Conventional cup tooth cutters, such as the cutter disclosed in the '588 patent, work effectively in easy digging conditions. However, in hard digging conditions, such cutters will generally wear out quickly. Consequently, conventional cup tooth cutters are not effective for excavating hard ground conditions.

SUMMARY OF THE INVENTION

One aspect of the present invention relates to a cutting tooth for a trencher chain. A cutting tooth includes a base portion aligned along a first plane. The base portion includes means for allowing the cutting tooth to be connected to the trencher chain. The tooth also includes a distal portion that is obliquely aligned with respect to the first plane. A curved transition is located between the distal portion and the base portion. The curved transition curves away from the first plane and at least partially forms a cupped portion that extends from a leading end to a trailing end of the cutting tooth. The cutting tooth further includes a hardened tip positioned at a region of the leading end that is located farthest from the first plane.

Another aspect of the present invention relates to a trenching or digging chain for use with a trencher. The chain includes a plurality of side bars aligned along a longitudinal centerline. The trencher chain also includes a plurality of rollers interconnecting the side bars. The rollers are aligned along a lateral dimension that is transverse with respect to the longitudinal centerline. The chain further includes a plurality of cutting teeth that curve laterally away from the longitudinal centerline. Each cutting tooth includes an outwardly facing cupped portion that provides means for removing geologic material from a trench. Each cutting tooth also includes a leading end having a hardened tip positioned at a region of the leading end that is located laterally farthest from the longitudinal centerline. When the chain is used to excavate the trench, only the hardened tips of the cutting teeth engage walls of the trench.

Another aspect of the present invention relates to a cutting tooth for a trencher chain. The cutting tooth includes a tooth member having a leading end and a trailing end. The tooth member also includes a base portion having a generally planar first surface aligned along a first plane. The base portion provides means for allowing the tooth member to be connected to the trencher chain. The tooth member further includes a distal portion that extends outward from the base member and away from the first plane. The distal portion is aligned generally at an oblique angle with respect to the first plane. The tooth member additionally includes a hardened tip positioned at a region of the distal portion that is located farthest from the first plane. The tooth member is arranged and configured such that no portion of the tooth member intersects the first plane.

A variety of advantages of the invention will be set forth in part in the description that follows, and in part will be apparent from the description, or may be learned by practicing the invention. It is to be understood that both the foregoing general description and the following detailed description are exemplary and explanatory only and are not restrictive of the invention as claimed.

BRIEF DESCRIPTION OF THE DRAWINGS

The accompanying drawings, which are incorporated in and constitute a part of the specification, illustrate several aspects of the invention and together with the description, serve to explain the principles of the invention. A brief description of the drawings is as follows.

DETAILED DESCRIPTION

Reference will now be made in detail to exemplary aspects of the present invention that are illustrated in the accompanying drawings. Wherever possible, the same reference numbers will be used throughout the drawings to refer to the same or like parts.

Figure 1:
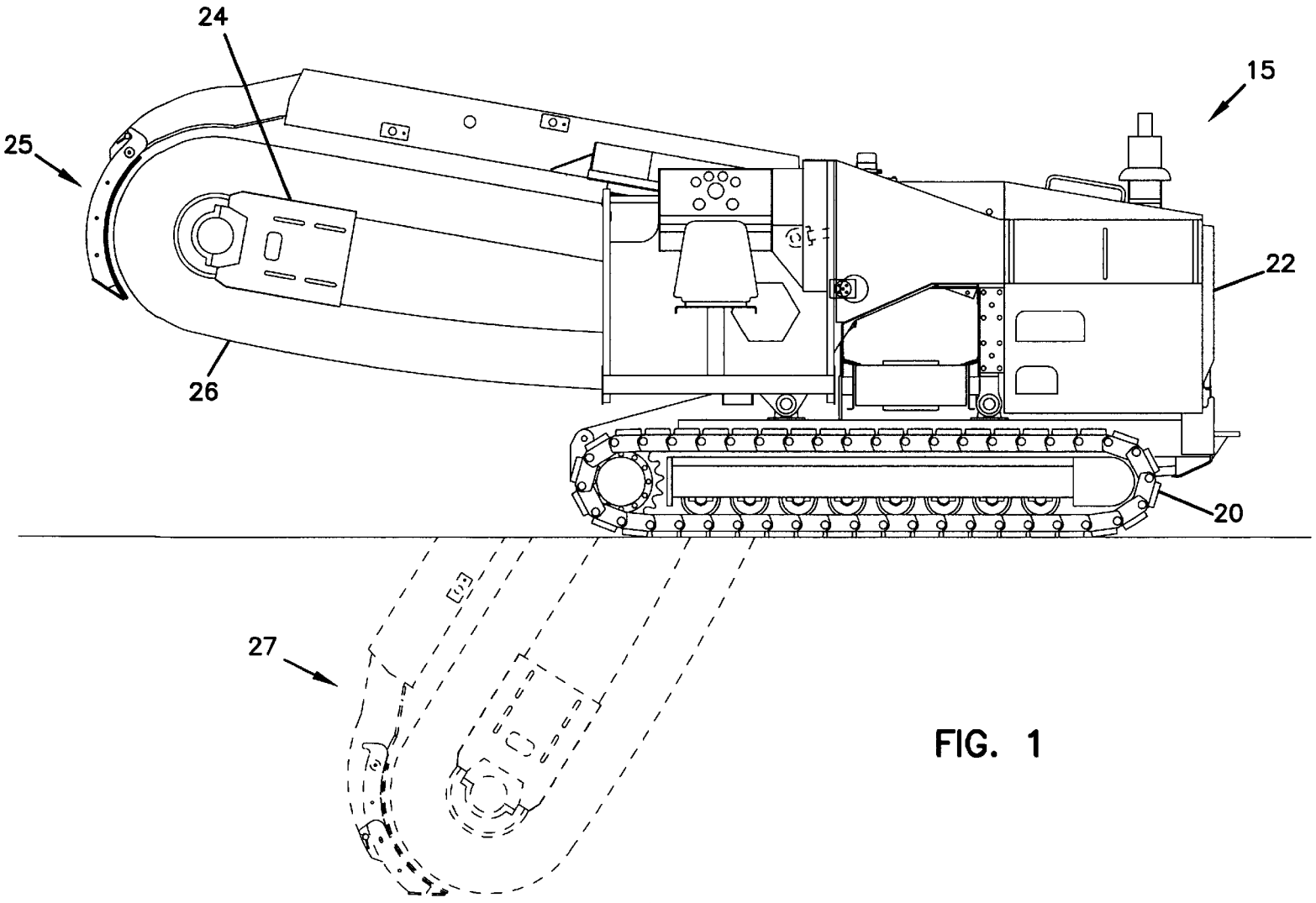
FIG. 1 shows a side view of a trencher.
Figure 2:
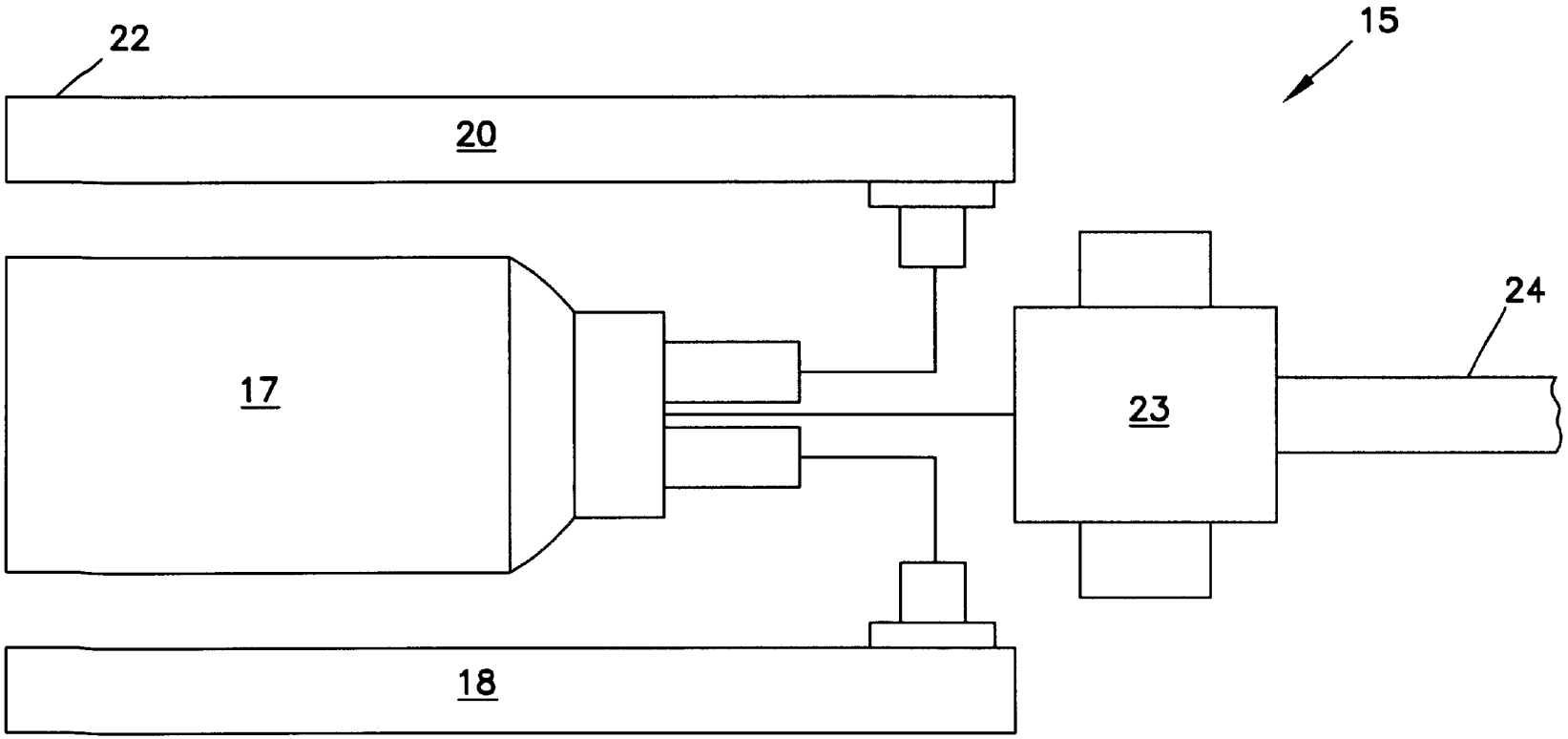
FIG. 2 shows a schematic diagram of the components of the trencher of FIG. 1.

FIGS. 1 and 2 show an exemplary trencher 15. The trencher 15 includes an engine 17 coupled to a right track drive 18 and a left track drive 20, which together form a tractor portion 22 of the trencher 15. A boom 24 is pivotally coupled to the tractor portion 22. A digger chain 26 is mounted on the boom 24. The chain 26 is driven around the boom 24 by a chain drive mechanism 23 powered by the engine 17. The boom 24 is pivotally movable between a substantially horizontal transport configuration 25, and a substantially vertical trenching configuration 27.

When maneuvering the trencher 15 around the work site, the boom 24 is maintained in the transport configuration 25 such that the chain 26 generally remains above the ground. To excavate a trench, the boom 24 is lowered toward the trenching configuration 27 and the chain 26 is driven around the boom 24. When the chain 26 contacts the ground, cutting teeth of the chain 26 penetrate the ground and begin to excavate a trench. Once the boom 24 reaches the trenching configuration 27, the tracks 18 and 20 are engaged causing the tractor 22 to creep forward. The chain 26 digs the trench and removes loose geologic material from the trench as the tractor 22 creeps forward.

The trencher 15 is being disclosed exclusively for the purpose of illustrating an exemplary environment in which the various aspects of the present invention can be applied. It will be appreciated that the variety of trenchers are known in the art, and that the various aspects of the present invention can be applied or used in association with any type of trenching device.

Figures 3A, 3B:
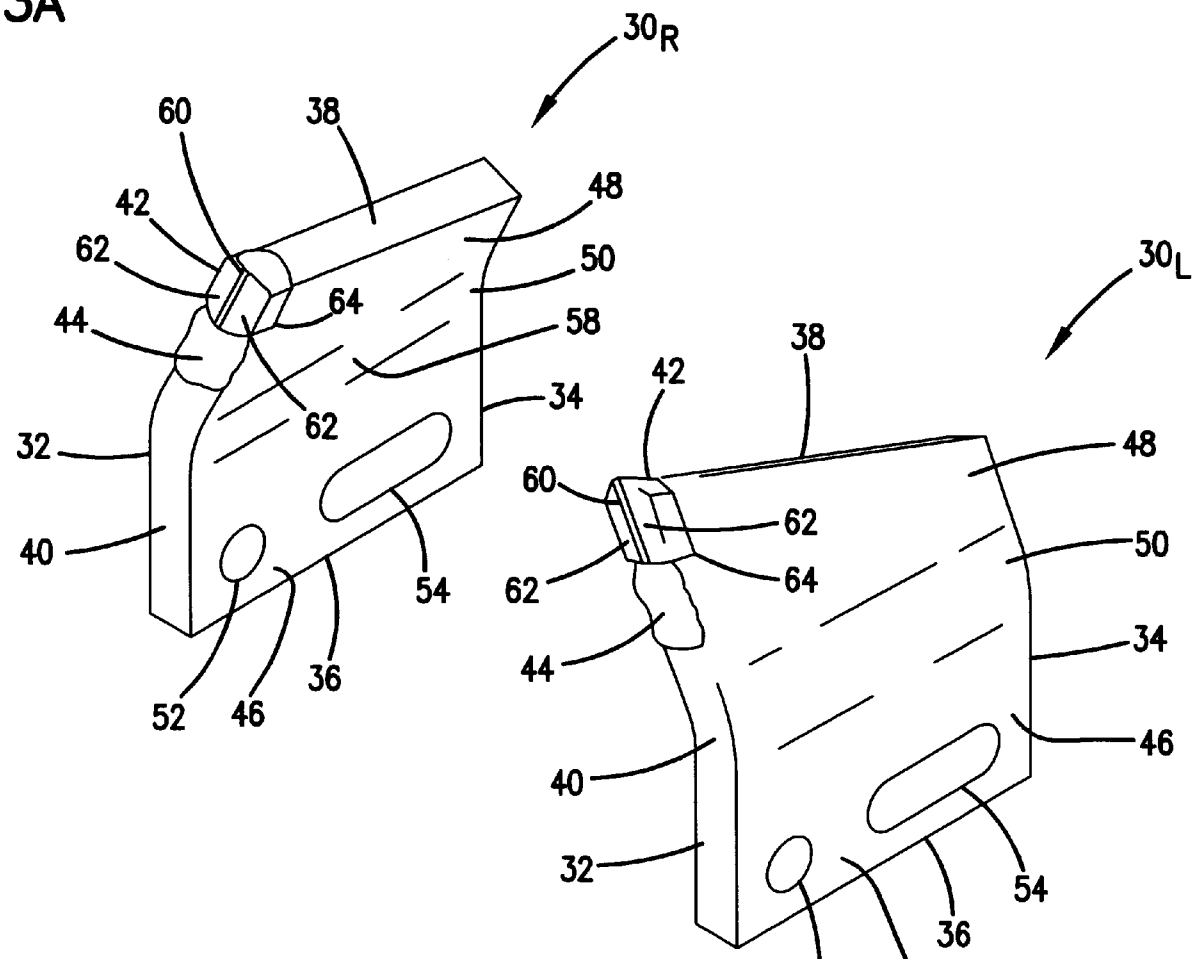
FIG. 3A is a perspective view of a cutting tooth constructed in accordance with the principles of the present invention, the cutting tooth curves to the right when viewed from the leading end of the cutting tooth.
FIG. 3B is a perspective view of another cutting tooth constructed in accordance with the principles of the present invention, the cutting tooth curves to the left when viewed from the leading end of the cutting tooth.

FIGS. 3A and 3B illustrate exemplary cutting teeth $\mathbf{30}_R$ and $\mathbf{30}_L$ that are embodiments of the present invention. The cutting teeth $\mathbf{30}_R$ and $\mathbf{30}_L$ are substantially the same except for the direction of curvature. For example, the cutting tooth $\mathbf{30}_R$ curves to the right when viewed from the leading end of the cutting tooth $\mathbf{30}_R$ as shown in FIG. 3A. By contrast, the cutting tooth $\mathbf{30}_L$ curves to the left when viewed from the leading end of the cutting tooth $\mathbf{30}_L$ as shown in FIG. 3B.

The cutting teeth $\mathbf{30}_R$ and $\mathbf{30}_L$ include leading ends 32 positioned opposite from trailing ends 34. The teeth $\mathbf{30}_R$ and $\mathbf{30}_L$ also include oppositely positioned base ends 36 and distal ends 38 that extend between the leading and trailing ends 32 and 34.

The leading and trailing ends 32 and 34 have generally planar faces or surfaces 40 that are generally parallel to one another (only the faces 40 of the leading ends 32 are shown). Hardened tips 42 are mounted at the interface between the leading ends 32 and the distal ends 38. Hard facing material 44 is positioned along the leading ends 32 directly beneath the hardened tips 42. The hard facing material 44 assists in inhibiting wash wear of the leading ends 32 beneath the hardened tips 42.

The base ends 36 of the teeth $\mathbf{30}_R$ and $\mathbf{30}_L$ extend transversely between the leading and trailing ends 32 and 34. The distal ends 38 of the teeth $\mathbf{30}_R$ and $\mathbf{30}_L$ are aligned at oblique angles with respect to the leading and trailing ends 32 and 34. For example, the distal ends 38 incline from the trailing ends 34 to the leading ends 32. The inclinations of the distal ends 38 form reliefs located behind the hardened tips 42.

Generally, the teeth $\mathbf{30}_R$ and $\mathbf{30}_L$ include base portions 46, distal portions 48, and transition portions 50 located between the base and distal portions 46 and 48. The base portions 46 include circular openings 52 and elongated openings 54 arranged and configured for allowing the teeth $\mathbf{30}_R$ and $\mathbf{30}_L$ to be bolted to a conventional trenching chain. It will be appreciated that alternative bolt hole patterns could also be used.

Figure 4A:
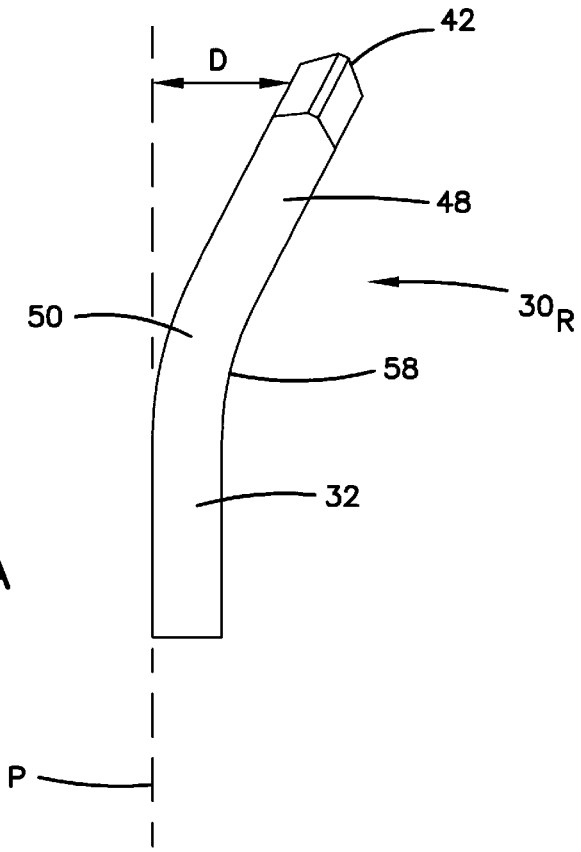
FIG. 4A is a leading end view of the cutting tooth of FIG. 3A.
Figure 4B:
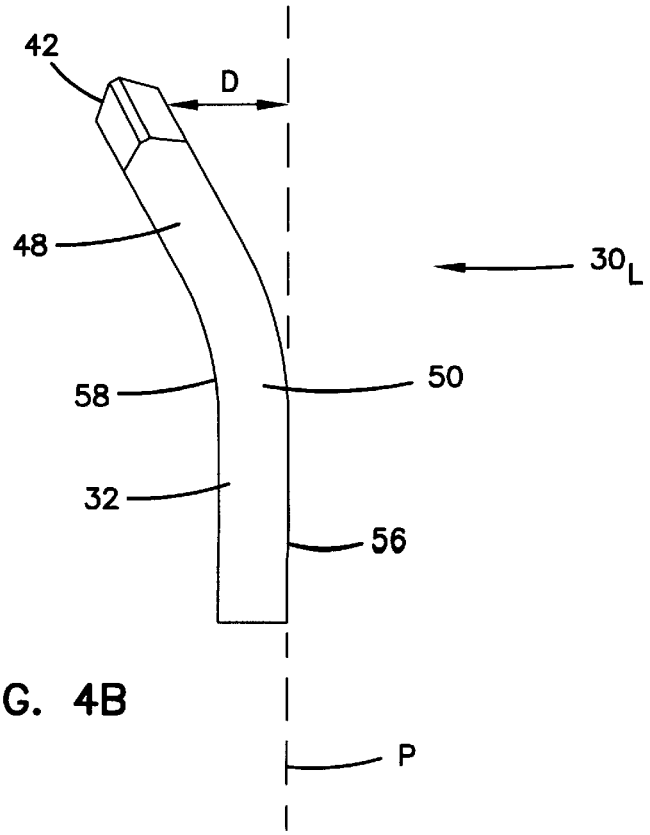
FIG. 4B is a leading end view of the cutting tooth of FIG. 3B.

The base portions 46 include generally planar surfaces 56 that extend between the leading and trailing ends 32 and 34. As shown in FIGS. 4A and 4B, the surfaces 56 are aligned generally along planes P. The transition portions 50 curve away from the planes P and at least partially form cupped portions 58. As shown in FIG. 3A, the cupped portions 58 are located on sides of the teeth $\mathbf{30}_R$ and $\mathbf{30}_L$ that are opposite from the surfaces 56. The cupped portions 58 have generally concave curvatures and preferably extend lengthwise from the leading ends 32 to the trailing ends 34 of the teeth $\mathbf{30}_R$ and $\mathbf{30}_L$. The location of the transition portion 50 and the generally concave nature of the cupped portions 58 facilitates moving or scooping loose geologic material from within a trench. As shown in FIGS. 4A and 4B, the transition portions 50 are located generally at mid regions of the teeth $\mathbf{30}_R$ and $\mathbf{30}_L$.

The distal portions 48 of the teeth 30 are aligned at oblique angles with respect to the planes P. As shown in FIGS. 4A and 4B, the distal portions 48 are substantially straight. However, it will be appreciated that the distal portions 48 could also be curved and still be considered obliquely aligned with respect to the planes P.

Referring again to FIGS. 4A and 4B, when moving from the base end 35 toward the distal ends 38 of the teeth $\mathbf{30}_R$ and $\mathbf{30}_L$, the entire length of each transition portion 50 extends continuously away from each corresponding plane P. Additionally, the distal portions 48 also extend continuously away from the planes P. Consequently, no portions of the teeth $\mathbf{30}_R$ and $\mathbf{30}_L$ intersect the planes P. In other words, the cutting teeth $\mathbf{30}_R$ and $\mathbf{30}_L$ are located completely on single sides of the planes P. Furthermore, the hardened tips 42 of the teeth $\mathbf{30}_R$ and $\mathbf{30}_L$ are positioned at regions of the leading ends 32 that are located farthest (i.e., a distance D) from the planes P.

The main bodies of the teeth $\mathbf{30}_R$ and $\mathbf{30}_L$ are preferably made of a relatively hard material such as steel. For example, the main bodies of the teeth $\mathbf{30}_R$ and $\mathbf{30}_L$ can be made of steel plates having widths from about 0.375 to 0.750 inches that have been milled or cut into a desired shape, and then pressed or stamped to form a desired curvature.

The hardened tips 42 of the teeth $\mathbf{30}_R$ and $\mathbf{30}_L$ are preferably made of a material that is harder than the material used to form the main bodies of the teeth. For example, the hardened tips 42 comprise solid carbide inlays. As shown in FIGS. 3A and 3B, the hardened tips 42 include leading edges 60 and ramped leading faces 62 located on opposite sides of the leading edges 60. The hardened tips 42 are mounted within notches 64 that have been milled into the main bodies of the teeth $\mathbf{30}_R$ and $\mathbf{30}_L$. The notches 64 form right angle shoulders located at the interface between the leading and distal ends 32 and 38 of the teeth $\mathbf{30}_R$ and $\mathbf{30}_L$. The hardened tips 42 can be secured within the notches 64 by a brazing process.

Figure 5:
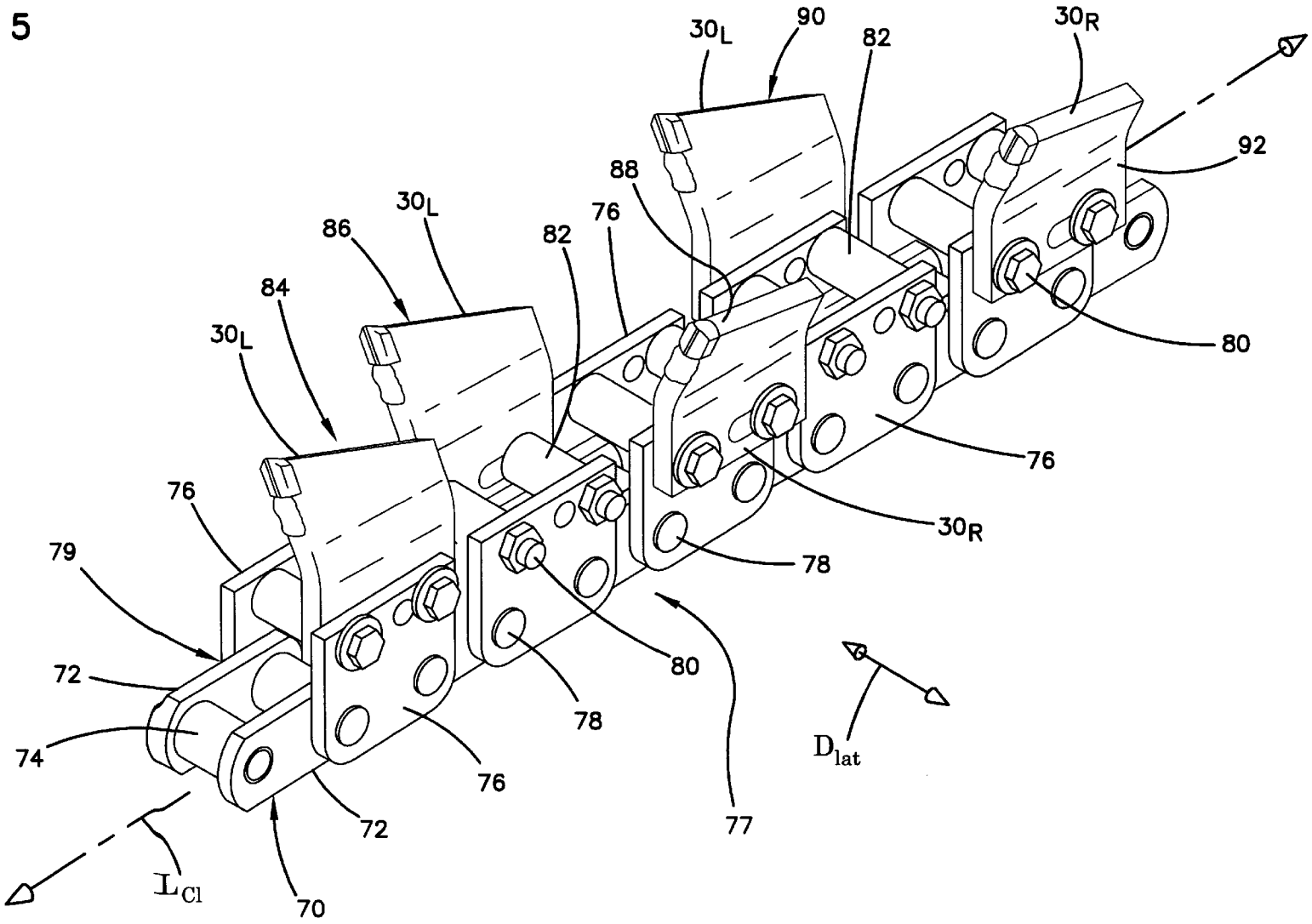
FIG. 5 is a perspective view of an exemplary cutting chain constructed in accordance with the principles of the present invention.

FIG. 5 is a perspective view of an embodiment of a trencher chain 70 constructed in accordance with the principles of the present invention. The chain 70 includes a plurality of side bars 72 aligned generally along a longitudinal centerline $L_{cl}$. The chain 70 also includes a plurality of rollers 74 interconnecting the side bars 72. The rollers 74 are aligned along a lateral dimension $D_{lat}$ that is transverse with respect to the longitudinal centerline $L_{cl}$. Side mounting plates 76 are connected to the chain 70 and extend generally along the side bars 72. For example, the side mounting plates 76 are shown connected to the chain 70 by rivets 78 that extend through the rollers 74. A plurality of the teeth $\mathbf{30}_R$ and $\mathbf{30}_L$ are connected to the side mounting plates 76 by bolts 80 that extend transversely through the side mounting plates 76 and also through the openings 52 and 54 defined by the teeth $30_R$ and $30_L$. The bolts 80 also extend through tube spacers 82 positioned between the side mounting plates 76. The tube spacers 82 assist in maintaining lateral spacing between the side mounting plates 76 when the bolts 80 are tightened.

FIG. 5 illustrates five teeth 84, 86, 88, 90, and 92 that are mounted on the chain 70. Tooth 84 is mounted inside the side mounting plates 76 adjacent a first side 77 of the chain 70. Tooth 84 curves laterally toward the longitudinal centerline $L_{cl}$ such that the cupped portions 58 of tooth 84 faces inwardly toward the centerline $L_{cl}$. Tooth 86 is also mounted between or inside the side mounting plates 76, but is located adjacent a second side 79 of the chain 70. Tooth 86 curves laterally away from the longitudinal centerline $L_{cl}$ such that the cupped portion 58 of tooth 86 faces outwardly away from the centerline $L_{cl}$. Tooth 88 is mounted outside the side mounting plates 76, and extends laterally away from the centerline $L_{cl}$ such that the cupped portion 58 of tooth 88 faces outwardly from the chain 70. Tooth 90 is also mounted outside the side mounting plates 76 adjacent the second side 79, and extends laterally away from the longitudinal centerline $L_{cl}$ such that the cupped portion 58 of tooth 90 faces outwardly. Tooth 92 has the same mounting configuration as tooth 88.

Figure 6:
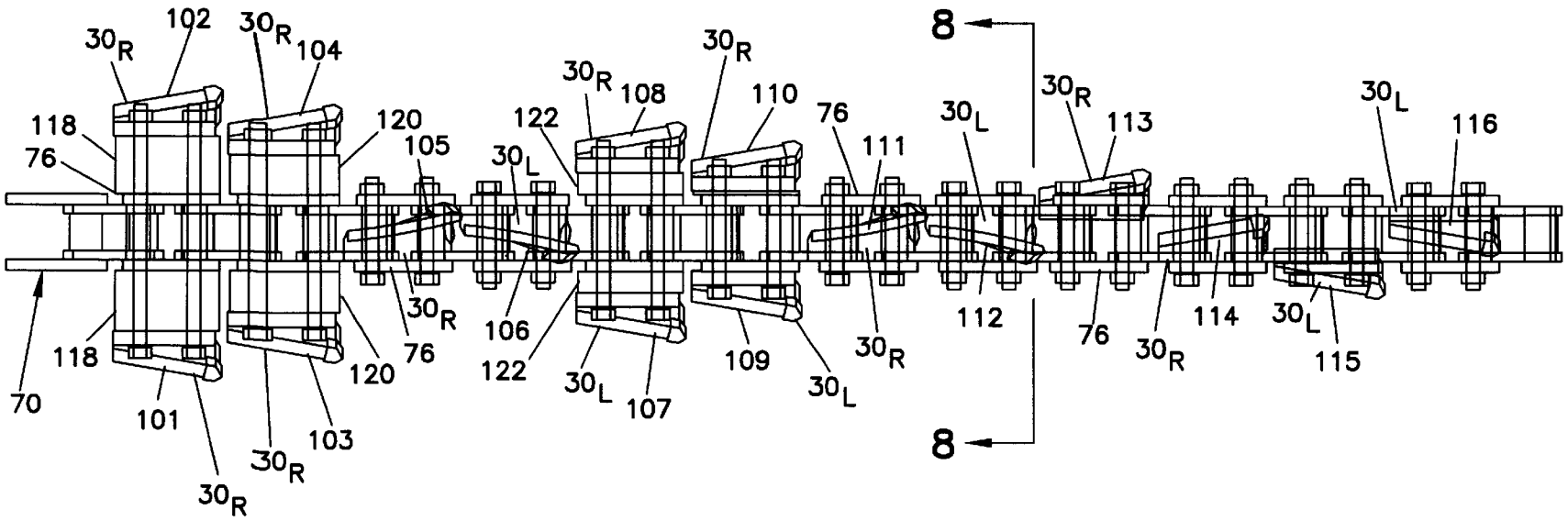
FIG. 6 is a top plan view of a trencher chain having a tooth mounting sequence in accordance with the principles of the present invention.

FIG. 6 is a plan view of an exemplary tooth mounting sequence that can be repeated throughout the length of an exemplary trencher chain. The sequence of FIG. 6 includes 16 cutting teeth 101–116. Cutting teeth 101 and 102 are paired on opposite sides of chain 70. Each of the cutting teeth 101 and 102 curves laterally away from the longitudinal centerline $L_{cl}$. Spacers 118 are used to space the teeth 101 and 102 up to about 6 inches laterally outward from the longitudinal centerline $L_{cl}$.

Teeth 103 and 104 are also spaced on opposite sides of the chain 70, and curve laterally away from the longitudinal centerline $L_{cl}$. Spacers 120 space the teeth 103 and 104 laterally outward from the longitudinal centerline $L_{cl}$. Spacers 120 are less thick than spacers 118 such that teeth 103 and 104 are staggered laterally inward relative to the teeth 101 and 102.

Teeth 105 and 106 are mounted inside the side mounting plates 76 and curve toward the longitudinal centerline $L_{cl}$. Teeth 105 and 106 cooperate to remove loose geologic material from a region of trench located directly beneath the chain 70.

Teeth 107 and 108 are paired on opposite sides of the chain 70 and curve laterally away from the longitudinal centerline $L_{cl}$. Spacers 122 space the teeth 107 and 108 laterally outward from the longitudinal centerline $L_{cl}$. The spacers 122 are thinner than the spacers 120. Consequently, the teeth 107 and 108 are staggered laterally inward relative to the teeth 103 and 104.

Teeth 109 and 110 are also paired on opposite sides of the chain 70, and curve laterally away from the longitudinal centerline $L_{cl}$. The teeth 109 and 110 are mounted outside the side mounting plates 76 and are staggered laterally inward relative to the teeth 107 and 108. Teeth 111 and 112 have the same mounting configurations as the teeth 105 and 106.

Tooth 113 is mounted inside the side mounting plates 76, and curves laterally away from the longitudinal centerline $L_{cl}$. The tooth 113 is staggered laterally inward relative to the tooth 110. Cutting tooth 114 is mounted inside the side mounting plates 76, and curves toward the longitudinal centerline $L_{cl}$. The cutting tooth 114 has substantially the same configuration as cutting teeth 105 and 111.

Cutting tooth 115 is mounted inside the side mounting plates 76, and extends laterally away from the longitudinal centerline $L_{cl}$. The tooth 115 is staggered laterally inward relative to tooth 109. Cutting tooth 116 is mounted inside the mounting plates 76 and curves toward the longitudinal centerline $L_{cl}$. The cutting tooth 116 has a similar mounting configuration to teeth 112 and 106.

Figure 7:
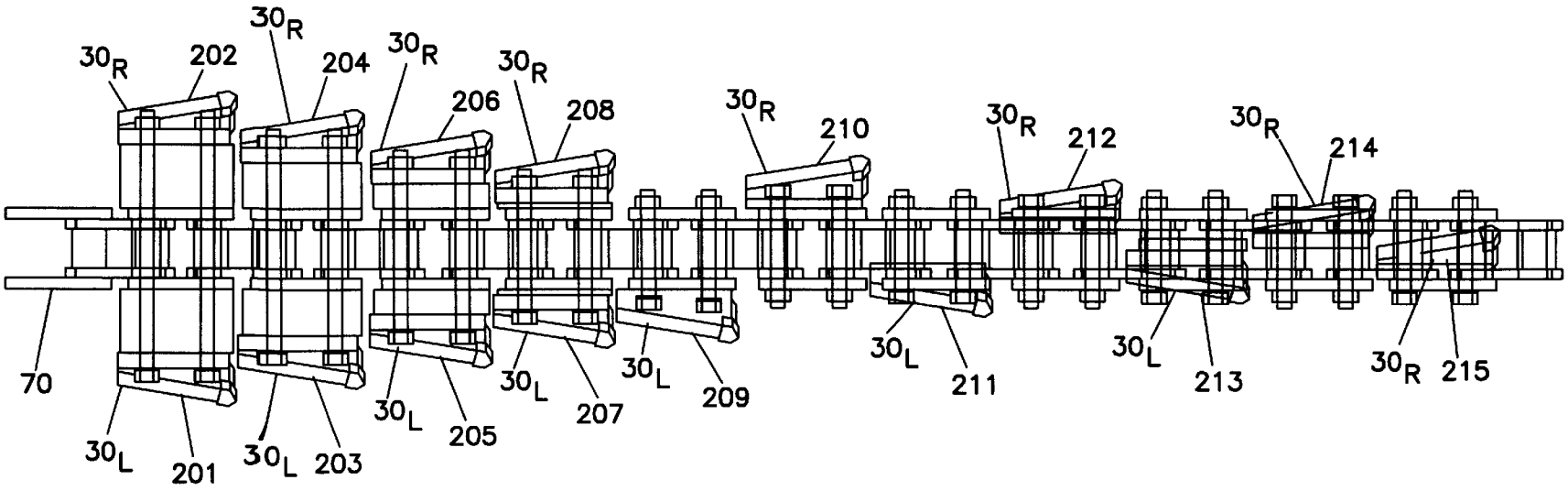
FIG. 7 is a top plan view of a trencher chain having another tooth mounting sequence in accordance with the principles of the present invention.

FIG. 7 illustrates another tooth sequence that can be repeated throughout the length of a trencher chain. The sequence includes 15 teeth 201–215. Teeth 201 and 202 curve outwardly from opposite sides of the chain 70. Teeth 203 and 204 curve outwardly from opposite sides of the chain 70, and are staggered laterally inward relative to the teeth 201 and 202. Teeth 205 and 206 curve outwardly from opposite sides of the chain 70, and are staggered laterally inward relative to teeth 203 and 204. Teeth 207 and 208 curve outwardly from opposite sides of the chain 70, and are staggered laterally inward relative to teeth 205 and 206. Tooth 209 curves outward from the chain 70, and is slightly staggered laterally inward relative to tooth 207. Tooth 210 curves outward from the chain 70, and is slightly staggered laterally inward relative to tooth 208. Tooth 211 curves outwardly from the chain 70, and is slightly staggered laterally inward relative to tooth 209. Tooth 212 curves outwardly from the chain 70, and is slightly staggered laterally inward relative to tooth 210. Tooth 213 curves outwardly from the chain 70, and is staggered laterally inward relative to tooth 211. Tooth 214 curves outwardly from the chain 70, and is staggered laterally inward relative to tooth 212. Finally, tooth 215 curves inwardly towards the longitudinal centerline $L_{cl}$, and is positioned at a mid-region of the chain 70.

Figure 8:
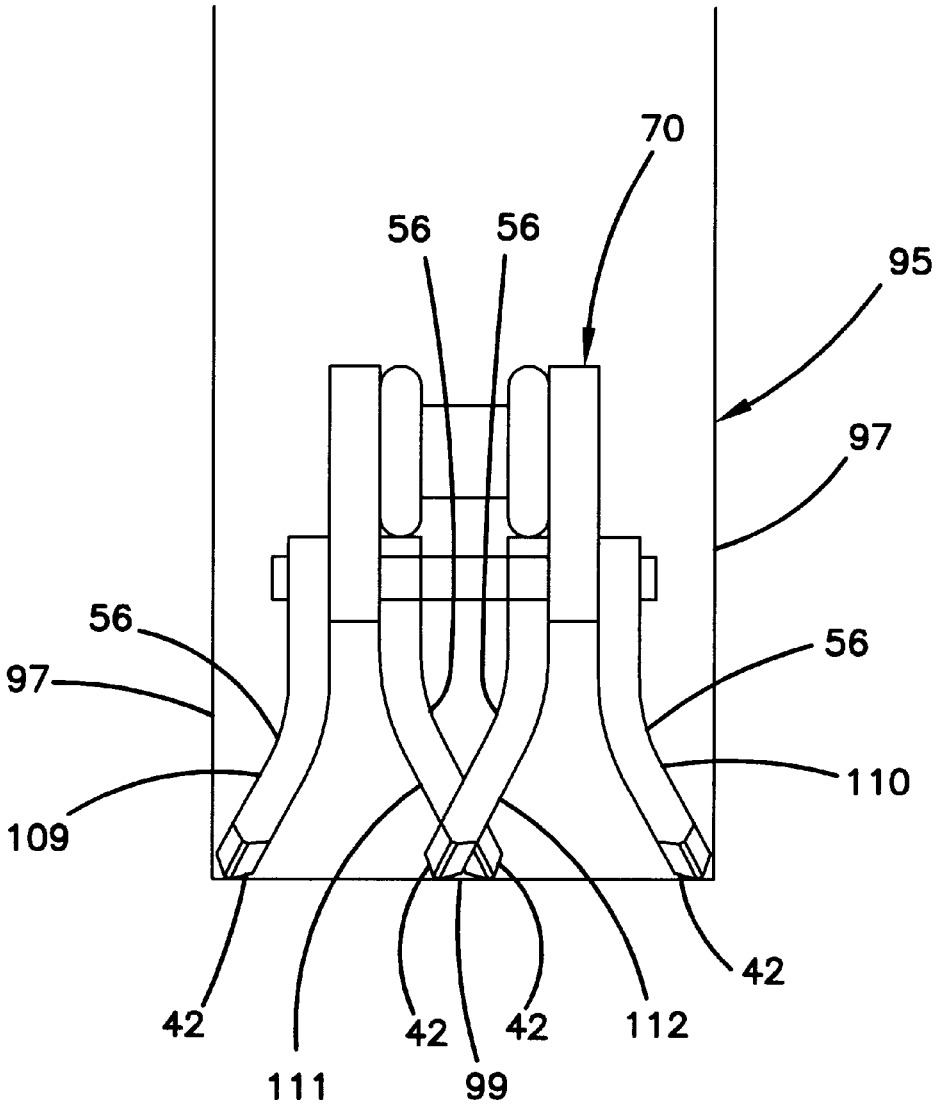
FIG. 8 is a cross-sectional view taken along section line 8—8 of FIG. 6.

FIG. 8 is a schematic cross-sectional view taken along section line 8—8 of FIG. 6. In FIG. 8, the chain 70 is inverted to show the hardened tips 42 engaging the bottom of a trench 95. For example, the hardened tips 42 of teeth 109 and 110 engage side walls 97 and a bottom wall 99 of the trench 95. Only the hardened tips 42 of the teeth 109 and 110 contact the walls 99 and 97 of the trench 95. Consequently, the teeth 109 and 110 resist wear and can be effectively used in hard digging conditions. Also, because only the tips engage the walls of the trench, less power is needed to drive the chain and chains having reduced tensile strengths can be used. For example, chains having tensile strengths in the range of 30,000–300,000 pounds can be used.

In direct contrast to conventional cup tooth cutters, the teeth 109 and 110 have cupped portions 58 that face outward toward the side walls 97 of the trench 95. In use, geologic material loosened by the hardened tips 42 flows between the side walls 97 and the cupped portions 58 of the teeth 109 and 110, and is subsequently scooped from the trench by the cupped portions 58.

The hardened tips 42 of teeth 111 and 112 engage the bottom wall 99 of the trench 95. To maximize wear life, only the hardened tips 42 of teeth 111 and 112 engage the bottom 99 of the trench 95. The cupped portions 56 of teeth 111 and 112 assist in scooping or removing loose geologic material from directly beneath the chain 70.

With regard to the foregoing description, it is to be understood that changes may be made in detail, especially in matters of the construction materials employed and the size, shape and arrangement of the parts with departing from the scope of the present invention. It is intended that the specification and the depicted aspects be considered exemplary only, with a true scope and spirit of the invention being indicated by the broad meaning of the following claims.

We claim:

1. A cutting tooth for a trencher chain, the cutting tooth comprising:

a base portion aligned along a first plane, the base portion including means for allowing the cutting tooth to be connected to the trencher chain;

a distal portion that is generally obliquely aligned with respect to the first plane, the distal portion having generally planar inner and outer surfaces;

a leading end and a trailing end with at least a portion of the leading end being generally planar and extending along at least the distal portion of the cutting tooth, the portion of the leading end having a width that extends from the inner surface to the outer surface of the distal portion with the portion of the leading end being substantially perpendicular to the first plane;

a curved transition located between the distal portion and the base portion, the curved transition curving away from the first plane and at least partially forming a cupped portion that extends from the leading end to the trailing end of the cutting tooth;

a hardened tip mounted within a notch defined by the distal portion and positioned at a region of the leading end that is located farthest from the first plane; and hard facing positioned along the leading end adjacent to the hardened tip.

2. The cutting tooth of claim 1, wherein the hardened tip is made of a solid carbide inlay.

3. The cutting tooth of claim 1 wherein the width of the portion of the leading end is between 0.375 and 0.750 inches wide.

4. The cutting tooth of claim 1 wherein the portion of the leading end further extends along the base portion and the curved transition of the cutting tooth.

5. The cutting tooth of claim 1, wherein the means for allowing the cutting tooth to be connected to the cutting chain comprises two openings that extend transversely through the base portion.

6. The cutting tooth of claim 1, wherein the distal portion includes a relieved distal surface that trails the hardened tip.

7. The cutting tooth of claim 1, wherein the entire curved transition curves continuously away from the first plane.

8. A trenching chain for a trencher, the chain comprising:

a plurality of side bars aligned along a longitudinal centerline;

a plurality of rollers interconnecting the side bars, the rollers being aligned along a lateral dimension that is transverse with respect to the longitudinal centerline; and a plurality of first cutting teeth that curve laterally away from the longitudinal centerline, each first cutting tooth including an outwardly facing cupped portion providing means for removing geologic material from a trench, each first cutting tooth also including a leading end having a hardened tip inlay positioned at a region of the leading end that is located laterally farthest from the longitudinal centerline;

hard facing positioned along the leading ends of the first cutting teeth adjacent to the hardened tips;

wherein the chain moves in a predetermined direction of movement to excavate the trench with only the hardened tip inlays of first cutting teeth engaging walls of the trench; and wherein the leading end includes at least a portion being generally planar and being proximate to the hardened tip inlay, the portion of the leading end defining a width of the cutting tooth that remains substantially constant from the leading end to the trailing end of the cutting tooth, the portion of the leading end being aligned generally perpendicular to the direction of movement of the trencher chain when the trencher chain is used to excavate the trench.

9. The chain of claim 8, wherein the hardened tips are made of solid carbide inlays.

10. The chain of claim 8 wherein the width of the portion of the leading end of each of the first cutting teeth is between 0.375 and 0.750 inches wide.

11. The chain of claim 8 wherein an entire length of the leading end of each of first cutting teeth extending from the hardened tip inlay is generally planar.

12. The chain of claim 8, wherein the first cutting teeth include relieved distal surfaces that trail the hardened tips.

13. The chain of claim 8, wherein the hardened tips of first cutting teeth on a same side of the chain are laterally staggered.

14. The chain of claim 8, further comprising a plurality of second cutting teeth that curve laterally toward the longitudinal centerline and include inwardly facing cupped portions.

15. A cutting apparatus comprising:

a trencher chain having a longitudinal centerline;

a tooth member including a base portion having a generally planar first surface aligned along a first plane, the base portion being connected to the trencher chain;

the tooth member also including a distal portion that extends outward from the base member and away from the first plane, the distal portion having generally planar inner and outer surfaces and being aligned generally at an oblique angle with respect to the first plane;

the tooth member having a leading end and a trailing end with at least a portion of the leading end being generally planar and extending along at least the distal portion of the tooth member, the portion of the leading end having a width that extends from the inner surface to the outer surface of the distal portion with the portion of the leading end being aligned generally perpendicular to the longitudinal centerline of the trencher chain when the cutting tooth is mounted on the trencher chain;

the tooth member further including a hardened tip inlay positioned at the leading end of the tooth member at a region of the distal portion that is located farthest from the first plane;

the tooth member being arranged and configured such that no portion of the tooth member intersects the first plane; and the tooth member including hard facing positioned along the leading end of the tooth member adjacent the hardened tip.

16. The cutting tooth of claim 15 wherein the width of the portion of the leading end of the tooth member is between 0.375 and 0.750 inches wide.

17. The cutting tooth of claim 15, wherein the leading and trailing ends are substantially parallel.

18. The cutting tooth of claim 15, further including a curved transition located between the distal portion and the base portion, the curved transition curving away from the first plane and at least partially forming a cupped portion that extends from the leading end to the trailing end of the tooth member.

19. The cutting tooth of claim 15, wherein the means for allowing the cutting tooth to be connected to the trencher chain comprises two openings that extend transversely through the base portion.

20. The cutting tooth of claim 18 wherein the portion of the leading end further extends along the base portion and the curved transition of the cutting tooth.

21. A cutting tooth for a trencher chain, the cutting tooth comprising:

a tooth member having a leading end and a trailing end;

the tooth member including a generally planar base portion adapted for connection to the trencher chain;

the tooth member also including a distal portion that extends outward from the base portion, the distal portion being generally obliquely aligned with respect to the base portion; and the cutting tooth also including a hardened distal tip inlay mounted within a notch defined by the distal portion and positioned at a region of the leading end of the tooth member that is located farthest from the first plane;

The tooth member including hard facing positioned along the leading end of the tooth member adjacent to the hardened tip inlay;

wherein at least a portion of the leading end of the tooth member is generally planar and is between 0.375 and 0.750 inches wide, the portion of the leading end extending along at least the distal portion of the tooth member.

22. The cutting tooth of claim 21 wherein the portion of the leading end further extends along the base portion.

* * * * *